US009326565B1

(12) United States Patent
Davis

(10) Patent No.: US 9,326,565 B1
(45) Date of Patent: May 3, 2016

(54) SHOE WITH INTERCHANGEABLE ATTACHABLE HEEL

(71) Applicant: DeShawn Davis, Brooklyn, NY (US)

(72) Inventor: DeShawn Davis, Brooklyn, NY (US)

( * ) Notice: Subject to any disclaimer, the term of this patent is extended or adjusted under 35 U.S.C. 154(b) by 44 days.

(21) Appl. No.: 14/330,279

(22) Filed: Jul. 14, 2014

(51) Int. Cl.

| | |
|---|---|
| ***A43B 21/36*** | (2006.01) |
| ***A43C 15/00*** | (2006.01) |
| ***A43B 21/37*** | (2006.01) |
| ***A43B 21/42*** | (2006.01) |
| ***A43B 21/52*** | (2006.01) |
| ***A43B 21/24*** | (2006.01) |
| ***A43B 21/50*** | (2006.01) |
| ***A43B 21/48*** | (2006.01) |

(52) U.S. Cl.
CPC ..... *A43B 21/52* (2013.01); *A43B 21/24* (2013.01); *A43B 21/36* (2013.01); *A43B 21/37* (2013.01); *A43B 21/48* (2013.01); *A43B 21/50* (2013.01)

(58) Field of Classification Search
CPC ..... A43B 21/24; A43B 21/36; A43B 21/37; A43B 21/48; A43B 21/50; A43B 21/52
USPC ..... 36/42, 41, 36 B, 36 C, 36 R, 67 D
See application file for complete search history.

(56) References Cited

U.S. PATENT DOCUMENTS

| | | | | | |
|---|---|---|---|---|---|
| 1,234,508 | A | | 7/1917 | Sztari | |
| 1,829,253 | A | * | 10/1931 | Zubia | A43B 21/48 36/42 |
| 2,752,698 | A | * | 7/1956 | Levine | A43B 21/00 36/34 R |
| 3,797,136 | A | * | 3/1974 | Soleri | A43B 21/50 36/42 |
| 3,805,418 | A | * | 4/1974 | Matuka | A43B 21/30 36/34 A |
| 4,363,177 | A | * | 12/1982 | Boros | A43B 21/39 36/101 |
| 4,667,421 | A | * | 5/1987 | Rouhani | A43B 21/51 36/36 C |
| 4,670,996 | A | * | 6/1987 | Dill | A43B 21/50 36/36 C |
| 5,058,290 | A | * | 10/1991 | Koehl | A43D 999/00 36/36 R |
| 5,079,857 | A | | 1/1992 | Clifton | |
| 5,524,365 | A | * | 6/1996 | Goldenberg | A43B 3/24 36/36 C |
| 5,542,198 | A | | 8/1996 | Famolare | |
| 5,953,836 | A | * | 9/1999 | Watt | A43B 3/24 36/100 |
| 6,631,570 | B1 | * | 10/2003 | Walker | A43B 3/24 36/100 |
| 8,132,341 | B1 | * | 3/2012 | Laramore | A43B 3/246 36/100 |

(Continued)

*Primary Examiner* — Clinton T Ostrup
*Assistant Examiner* — Cameron A Carter
(74) *Attorney, Agent, or Firm* — Williams Intellectual Property; Benjamin F. Williams

(57) ABSTRACT

A shoe with interchangeable attachable heel that includes a connection seat disposed upon a sole of an extant shoe, said connection seat disposed between a shank and a counter of said extant shoe, wherein a top plate, disposed atop at least one attachable heel, is expediently connectable to the connection seat by sliding engagement therewith and superimposition thereupon, whereby a lozenge-shaped protrusion disposed atop the top plate is positional for engagement interior to a connection aperture centrally disposed upon the connection seat, and each of a pair of arcuate rails slidingly engages interior to each of a pair of arcuate channels disposed upon the connection seat, whereby a plurality of pegs are extendable interior to each of a plurality of holes disposed upon the connection seat and the attachable heel is expediently securable for custom wear upon the connection seat, as desired.

1 Claim, 3 Drawing Sheets

(56) References Cited

U.S. PATENT DOCUMENTS

| | | | | |
|---|---|---|---|---|
| 8,505,218 | B2 * | 8/2013 | Angiulo | A43B 3/246 36/100 |
| 8,832,968 | B2 * | 9/2014 | Terrida | A43B 21/51 36/36 C |
| 9,009,990 | B2 * | 4/2015 | Angiulo | A43B 21/51 36/100 |
| 2001/0052195 | A1 * | 12/2001 | Blakey | A43B 3/24 36/100 |
| 2006/0075662 | A1 * | 4/2006 | Schupbach | A43B 3/24 36/100 |
| 2007/0011909 | A1 * | 1/2007 | Palmeri, III | A43B 3/24 36/42 |
| 2011/0099841 | A1 * | 5/2011 | Howard | A43B 3/0042 36/42 |
| 2012/0066845 | A1 * | 3/2012 | Terrida | A43B 21/51 12/103 |
| 2012/0137543 | A1 * | 6/2012 | Kemp | A43B 3/24 36/100 |
| 2012/0186105 | A1 * | 7/2012 | Kemp | A43B 3/24 36/100 |
| 2013/0062231 | A1 * | 3/2013 | Angiulo | A43B 3/246 206/278 |
| 2013/0067770 | A1 * | 3/2013 | Sherwood | A43B 21/47 36/100 |
| 2013/0206619 | A1 * | 8/2013 | Angiulo | A43B 21/51 206/278 |
| 2013/0247412 | A1 * | 9/2013 | Du Coeur | A43B 21/36 36/42 |
| 2013/0255110 | A1 * | 10/2013 | Jang | A43B 21/42 36/36 R |
| 2013/0312285 | A1 * | 11/2013 | Sharma | A43B 21/42 36/100 |
| 2014/0115921 | A1 * | 5/2014 | Pitcock | A43B 21/46 36/42 |

* cited by examiner

SHOE WITH INTERCHANGEABLE ATTACHABLE HEEL

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of shoes with attachable heels are known in the prior art. However, what is needed is a shoe with interchangeable attachable heel that includes a connection seat disposed upon a sole of an extant shoe, said connection seat disposed between a shank and a counter of said extant shoe, wherein a top plate, disposed atop at least one attachable heel, is expediently connectable to the connection seat by sliding engagement therewith and superimposition thereon, whereby a lozenge-shaped protrusion disposed atop the top plate is positional for engagement interior to a connection aperture centrally disposed upon the connection seat, and each of a pair of arcuate rails slidingly engages interior to each of a pair of arcuate channels disposed upon the connection seat, whereby a plurality of pegs are extendable interior to each of a plurality of holes disposed upon the connection seat and the attachable heel is expediently securable for custom wear upon the connection seat, as desired.

FIELD OF THE INVENTION

The present invention relates to a shoe with interchangeable attachable heel, and more particularly, to a shoe with interchangeable attachable heel that includes a connection seat disposed upon a sole of an extant shoe, said connection seat disposed between a shank and a counter of said extant shoe, wherein a top plate, disposed atop at least one attachable heel, is expediently connectable to the connection seat by sliding engagement therewith and superimposition thereon, whereby a lozenge-shaped protrusion disposed atop the top plate is positional for engagement interior to a connection aperture centrally disposed upon the connection seat, and each of a pair of arcuate rails slidingly engages interior to each of a pair of arcuate channels disposed upon the connection seat, whereby a plurality of pegs are extendable interior to each of a plurality of holes disposed upon the connection seat and the attachable heel is expediently securable for custom wear upon the connection seat, as desired.

SUMMARY OF THE INVENTION

The general purpose of the shoe with interchangeable attachable heel, described subsequently in greater detail, is to provide a shoe with interchangeable attachable heel which has many novel features that result in a shoe with interchangeable attachable heel which is not anticipated, rendered obvious, suggested, or even implied by prior art, either alone or in combination thereof.

The present shoe with interchangeable attachable heel has been devised to enable expedient interchange of at least one attachable heel upon a shoe for custom wear, as desired. The present shoe with interchangeable attachable heel releasably secures at least one attachable heel to a shoe by interconnection of a top plate, disposed atop the at least one attachable heel, and a connection seat disposed upon the shoe sole, whereby said at least one attachable heel is positional upon the shoe for custom wear, as desired.

The present shoe with interchangeable heel, therefore, includes a connection seat disposed upon a sole of an extant shoe, said connection seat disposed between a counter and shank of said shoe, whereat at least one attachable heel is securable for custom wear, as desired.

The connection seat includes a leading edge, disposed most proximal the shoe shank, and a posterior edge, disposed most proximal the shoe counter. A connection aperture is disposed centrally within the connection seat and a U-shaped cup is disposed interior to the connection aperture. The U-shaped cup is disposed open-ended toward the leading edge, whereby a central channel, recessed into the connection seat between the leading edge and the connection aperture, enables slidable positioning of a lozenge-shaped protrusion, disposed upon at least one attachable heel, for engagement with the U-shaped cup, as will described subsequently.

A pair of arcuate channels is disposed on either side of the connection aperture. Each of the pair of arcuate channels is open-ended at the leading edge and terminates proximal the posterior edge of the connection seat. Each of the pair of arcuate channels is disposed to guide each of a corresponding pair of arcuate rails, disposed upon the at least one attachable heel, to seat the at least one attachable heel upon the connection seat, as will be described subsequently.

A plurality of holes is disposed upon the connection seat, each of said plurality of holes situated for insertable reception of each of a plurality of pegs disposed upon the at least one attachable heel, as will be described subsequently. Each of the plurality of holes, therefore, receives thereinto a corresponding one of a plurality of pegs disposed upon the at least one attachable heel, whereby slidable disconnection of the at least one attachable heel from the connection seat is preventable by each of said plurality of pegs.

The at least one attachable heel, therefore, is securable to the connection seat by interconnection and superimposition of a top plate therewith. The top plate includes a lozenge-shaped protrusion centrally disposed thereupon, said lozenge-shaped protrusion disposed for slidable insertion into the central channel for engagement in the U-shaped cup disposed interior to the connection aperture. Each of a pair of arcuate rails, disposed on either side of the lozenge-shaped protrusion, are disposed upon the top plate for guided insertion into each of the pair of arcuate channels disposed in the connection seat.

Each of the pair of arcuate channels, therefore, guides each of the pair of arcuate rails to position the lozenge-shaped protrusion along the central channel into the U-shaped cup in the connection aperture and also to situate each of a plurality of pegs, disposed atop the top plate, for reception into each of the plurality of holes. Each of the pair of arcuate rails is curved, whereby a greater line of contact is afforded between the top plate and the connection seat for increased strength and security of the at least one attachable heel connected thereto.

Each of the plurality of pegs is extensionally tensioned to insert into each of the plurality of holes when a release button, disposed upon the at least one attachable heel, is released. A user, therefore, depresses the release button, fits the lozenge-shaped protrusion into the central channel and each of the arcuate rails into a corresponding one of the arcuate channels, thence slides the at least one attachable heel into position until the lozenge-shaped protrusion seats into the U-shaped cup. Now that the at least one attachable heel is situated correctly relative the connection seat, release of the release button, therefore, extends each of the plurality of pegs into a corresponding one of the plurality of holes whereby the heel is secured in position upon the connection seat.

Removal of the at least one attachable heel is effective by depression of the release button, which thence effects retraction of each of the plurality of pegs into the top plate, whereby slidable disengagement of the top plate from the connection seat is enabled by withdrawal of the lozenge-shaped protrusion through the central channel and each of the pair of arcuate rails through the corresponding one of the pair of arcuate channels, whereby removal of the at least one heel is expediently enabled by sliding action at the leading edge of the connection seat, as desired.

Thus has been broadly outlined the more important features of the present shoe with interchangeable attachable heel so that the detailed description thereof that follows may be better understood and in order that the present contribution to the art may be better appreciated.

Objects of the present shoe with interchangeable attachable heel, along with various novel features that characterize the invention are particularly pointed out in the claims forming a part of this disclosure. For better understanding of the shoe with interchangeable attachable heel, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
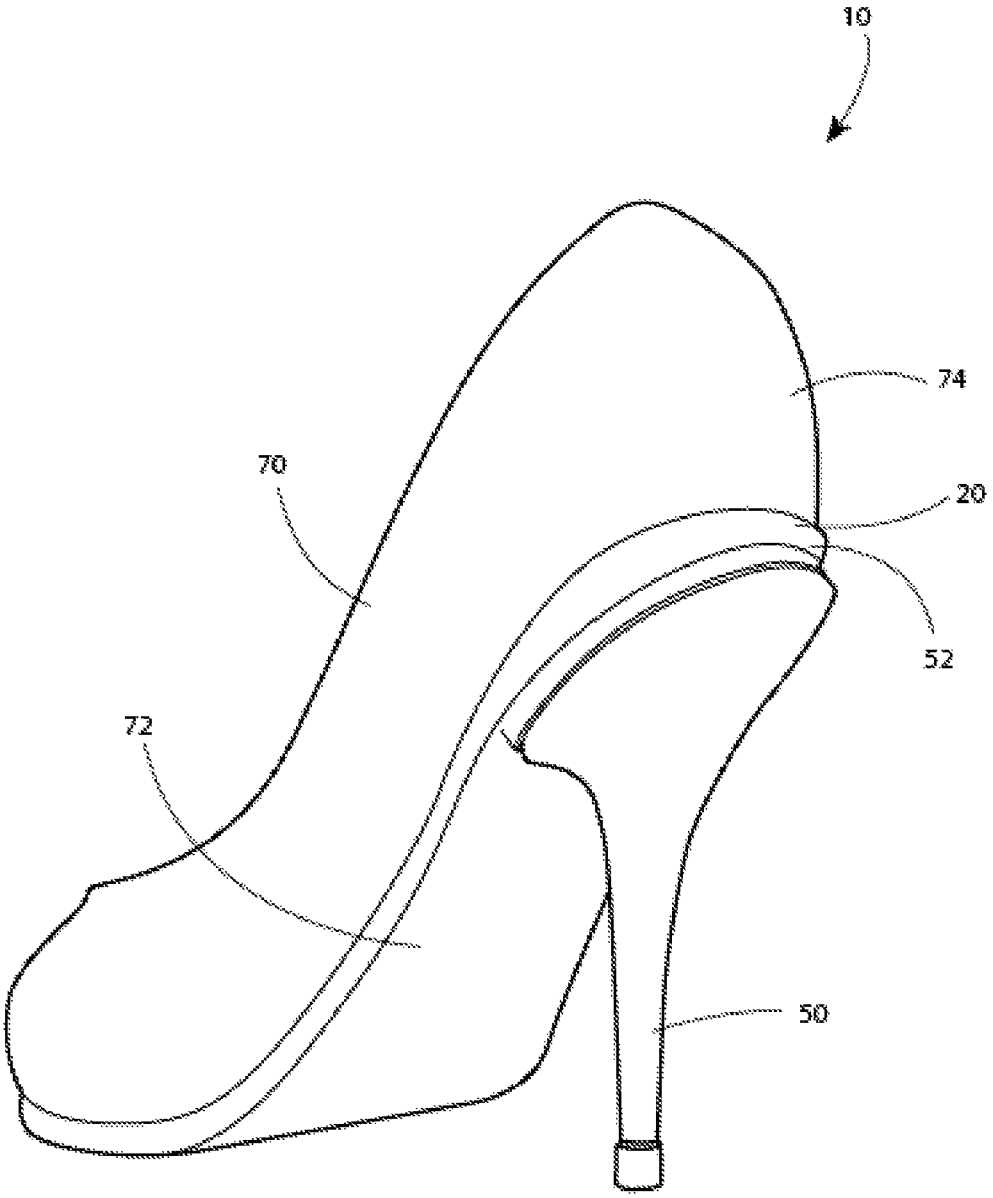
FIG. 1 is an isometric view of at least one attachable heel secured to a connection seat disposed upon an extant shoe.
Figure 2:
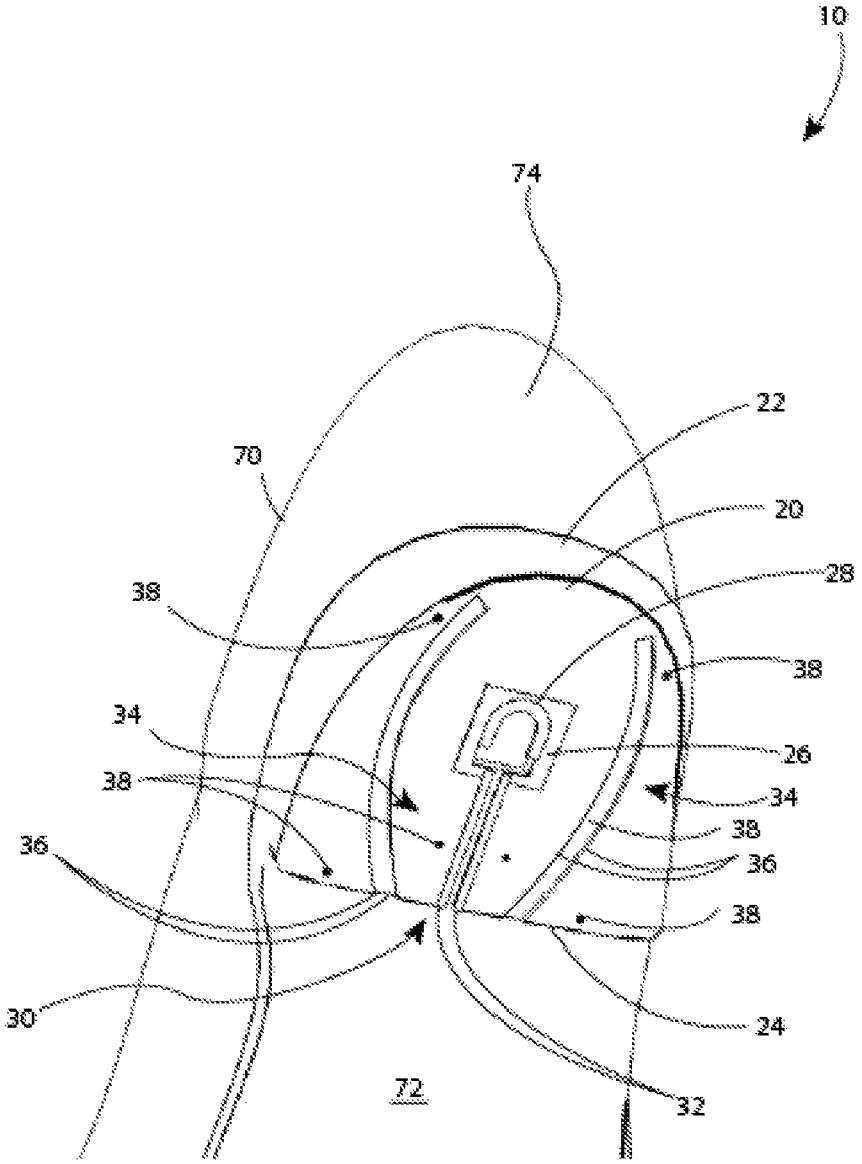
FIG. 2 is an isometric view of a connection seat disposed upon a sole of said extant shoe.
Figure 3:
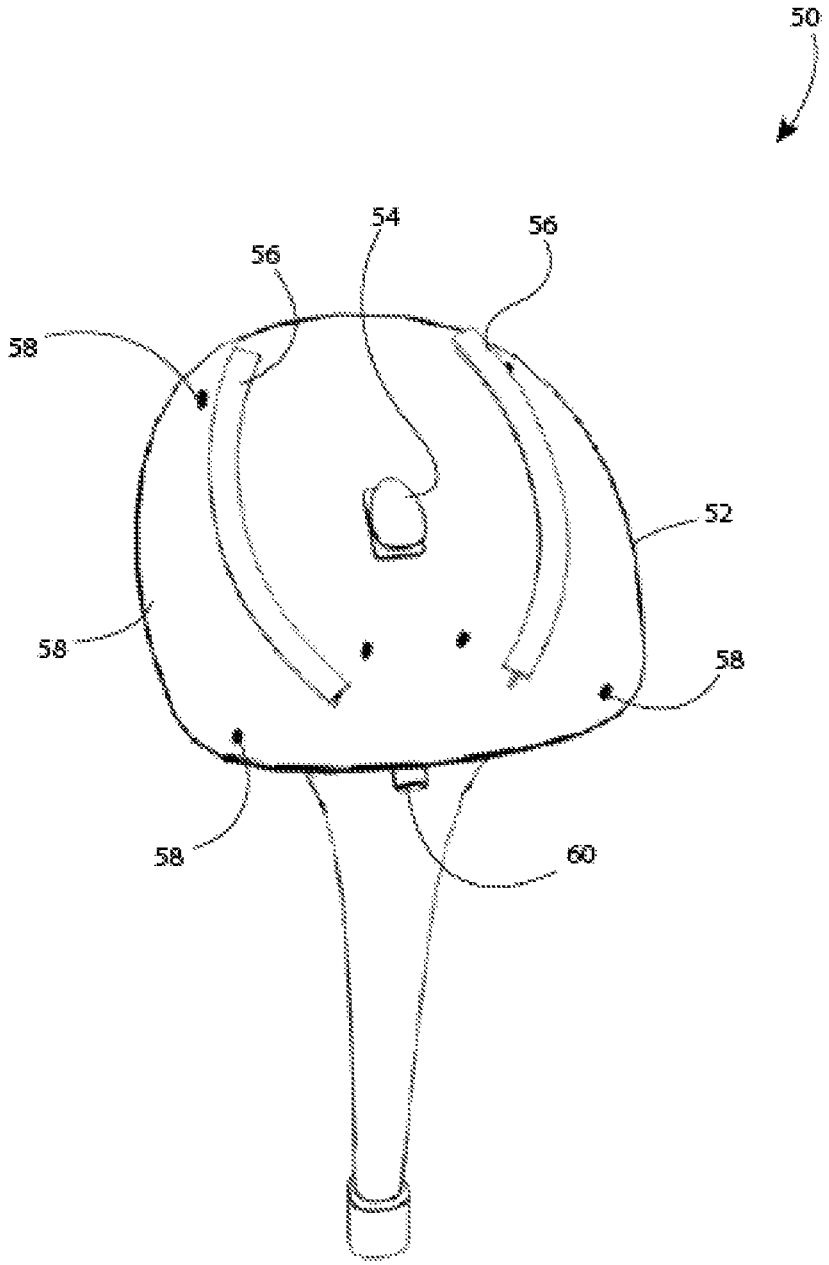
FIG. 3 is an isometric view of a top plate disposed atop at least one attachable heel.

With reference now to the drawings, and in particular FIGS. 1 through 3 thereof, example of the instant shoe with interchangeable attachable heel employing the principles and concepts of the present shoe with interchangeable attachable heel and generally designated by the reference number 10 will be described.

Referring to FIGS. 1 through 3 a preferred embodiment of the present shoe with interchangeable attachable heel 10 is illustrated.

The present shoe with interchangeable heel 10 has been devised to enable attachment of at least one attachable heel 50 to a connection seat 20 disposed upon a extant shoe 70, whereby custom wear of at least one attachable heel 50 is effective. The present shoe with interchangeable heel 10 enables expedient attachment and detachment of at least one attachable heel 50 from a shoe 70 by sliding engagement of said heel 50 into a connection seat 20 for secure deployment thereat, and a depressible release button 60 enables slidable disengagement from the connection seat 20 whereby the at least one attachable heel 20 is expediently removable, as desired.

The present shoe with interchangeable attachable heel 10, therefore, includes a connection seat 20 disposed on a sole of an extant shoe 70, said connection seat 20 disposed between a shank 72 and a counter 74 of said shoe 70. The connection seat 20 is therefore disposed for attachment of at least one attachable heel 50, whereby at least one attachable heel 50 is securable thereto, and interchangeable thereat, as desired, as will be described subsequently.

The connection seat 20 includes a leading edge 22 disposed most proximal the shoe shank 72 and a posterior edge 24 disposed most proximal the shoe counter 74. A connection aperture 26 is disposed centrally in the connection seat 20 wherein a U-shaped cup 28 is centrally disposed, said U-shaped cup 28 facing open-ended toward the leading edge 22.

A central channel 30 is disposed open-ended between the leading edge 22 and the connection aperture 26, said central channel including an overhanging edge 32 on either side thereof. A pair of arcuate channels 34 is disposed on either side of the connection aperture 26, each of said pair of arcuate channels 34 open-ended at the leading edge 22 and terminating proximal the posterior edge 24. Each of the arcuate channels 34 likewise includes an overhanging edge 36 on either side thereof.

A plurality of holes 38 is disposed in the connection seat 20 for reception of each of a plurality of pegs 58 disposed upon a top plate 52 of at least one attachable heel 50, a will be described forthwith.

At least one attachable heel 50, therefore, is connectable to the connection seat 20. The at least one attachable heel 50 includes a top plate 52 disposed atop said heel 50, said top plate 52 interconnectable with, and superimposable upon, the connection seat 20 to secure the at least one attachable heel 50 in position thereat and effect expedient detachment therefrom, as desired.

A lozenge-shaped protrusion 54 is centrally disposed upon the top plate 52, said lozenge-shaped protrusion 54 fittable into the central channel 30 of the connection seat 20, and slidable therein between each overhanging edge 32 to seat within the connection aperture 26 engaged thereat by the U-shaped cup 28.

A pair of arcuate rails 56 is disposed on either side of the lozenge-shaped protrusion 54, each of said pair of arcuate rails 56 slidable into a corresponding one of the pair of arcuate channels 34 to engage each of a plurality of pegs 58, disposed upon the top plate 52, interior to each of the plurality of holes 38 disposed upon the connection seat 20. Each of the plurality of pegs 58 is extensionally tensioned to seat into each of the plurality of holes 38 when positioned thereunder.

A release button 60 is disposed upon the at least one attachable heel 50 underneath the top plate 52 in position to underlie the shank 72 of the shoe 70 when said at least one attachable heel 50 is attached to the connection seat 20, and thereat remain inconspicuous when the at least one attachable heel 50 is worn. Depression of the release button 60 effects retraction of each of the plurality of pegs 58 into the top plate 52 whereby the release button 60 is depressible to enable slidable engagement of the top plate 52 with the connection seat and, also, slidable disengagement of the top plate 52 from the connection seat 20, as desired.

Thus the lozenge-shaped protrusion 54 and each of the pair of arcuate rails 56 are engagable in the connection seat 20 to slidably secure the at least one attachable heel 50 to the connection seat 20 to secure the at least one attachable heel 50 in position for wear, and the release button 60 is accessibly depressible to effect slidable disengagement of the top plate 52 from the connection seat 20, whereby at least one attachable heel 50 is detachable from a shoe 70 and interchangeable thereat for custom wear, as desired.

What is claimed is:

1. A shoe with interchangeable attachable heel comprising:

a connection seat disposed on a sole of an extant shoe, said connection seat disposed between a shank and a counter of said shoe, said connection seat comprising:

a leading edge disposed most proximal the shoe shank;

a posterior edge disposed most proximal the shoe counter; a connection aperture disposed centrally in the connection seat;

a U-shaped cup disposed centrally within the connection aperture, said U-shaped cup facing open-ended toward a toe of the shoe;

a central channel disposed between the leading edge and the connection aperture;

a pair of arcuate channels disposed on either side of the connection aperture, each of said pair of arcuate channels open-ended at the leading edge, each of said pair of arcuate channels terminating proximal the posterior edge;

a plurality of holes disposed in the connection seat; at least one attachable heel connectable to the connection seat, said at east one attachable heel comprising:

a top plate disposed atop the at least one attachable heel; a lozenge-shaped protrusion centrally disposed upon the top plate, said lozenge-shaped protrusion fittable into the central channel of the connection seat and slidable therein to seat within the connection aperture and engaged therein at the U-shaped cup; a pair of arcuate rails disposed on either side of the lozenge shaped protrusion, each of said pair of arcuate rails slidable into a corresponding one of the pair of arcuate channels;

a plurality of pegs disposed upon the top plate, each of said plurality of pegs dispositional interior to each of the plurality of holes disposed upon the connection seat; and a release button disposed upon the heel underneath the top plate, said release button depressible to retract each of the plurality of pegs into the top plate to thereby enable slidable disengagement of the top plate from the connection seat;

wherein the lozenge-shaped protrusion and each of the pair of arcuate rails are engaged in the connection seat to slidably secure the at least one attachable heel to the connection seat, and the release button is depressible to effect slidable disengagement of the top plate from the connection seat, whereby at least one heel is attachable to a shoe and interchangeable thereat.

* * * * *